US011117012B2

(12) United States Patent
Petrakis et al.

(10) Patent No.: US 11,117,012 B2
(45) Date of Patent: Sep. 14, 2021

(54) BREATHABLE HEAVYWEIGHT GARMENTS FOR PHYSICAL CONDITIONING

(71) Applicant: Lawrence T. Petrakis, San Francisco, CA (US)

(72) Inventors: Lawrence T. Petrakis, San Francisco, CA (US); Augustin Vergara, San Rafael, CA (US)

(73) Assignee: Lawrence T. Petrakis, San Francisco, CA (US)

( * ) Notice: Subject to any disclaimer, the term of this patent is extended or adjusted under 35 U.S.C. 154(b) by 421 days.

(21) Appl. No.: 15/862,447

(22) Filed: Jan. 4, 2018

(65) Prior Publication Data

US 2018/0193687 A1 Jul. 12, 2018

Related U.S. Application Data

(60) Provisional application No. 62/443,610, filed on Jan. 6, 2017.

(51) Int. Cl.
*A63B 21/065* (2006.01)
*A41D 31/04* (2019.01)
(Continued)

(52) U.S. Cl.
CPC ..... *A63B 21/065* (2013.01); *A41D 1/02* (2013.01); *A41D 13/1245* (2013.01);
(Continued)

(58) Field of Classification Search
CPC ..... A63B 21/065; A63B 21/4005; A63B 21/4011; A63B 21/4007; A63B 21/0601;
(Continued)

(56) References Cited

U.S. PATENT DOCUMENTS 2,122,873 A * 7/1938 Shuster ..... A41D 27/10 2/126
3,659,843 A 5/1972 Kokigian, Jr.
(Continued)

FOREIGN PATENT DOCUMENTS

CL 2017001875 A1 12/2017
EP 0953594 A1 11/1999
GB 2462477 2/2010

OTHER PUBLICATIONS

"Interceptor Body Armor", Wikipedia, https://en.wikipedia.org/wiki/Interceptor_Body_Armor (13 pages) first pub. Feb. 24, 2004.*
(Continued)

*Primary Examiner* — Amy Vanatta
(74) *Attorney, Agent, or Firm* — Knobbe, Martens, Olson & Bear, LLP

(57) ABSTRACT

In some embodiments, a heavyweight jacket includes a main body configured to fit on the torso of a wearer and sleeves that are fully detached from the main body. The sleeves advantageously facilitate putting on the heavy jacket, while providing a jacket of high weight. To form the heavyweight jacket, a pre-bonded fabric may be used. The fabric is pre-bonded and may optionally be further layered to increase the garment's weight without sacrificing flexibility or breathability. The layered fabric distributes the garment's weight evenly and ensures that the garment does not excessively restrict a wearer's freedom of movement or cause the wearer to overheat. The weight of the fabric may be increased by using a heavyweight glue to bond various layers of material together.

12 Claims, 12 Drawing Sheets

(51) Int. Cl.

| | |
|---|---|
| ***A41D 1/02*** | (2006.01) |
| ***A41D 27/10*** | (2006.01) |
| ***A63B 21/00*** | (2006.01) |
| ***A41D 13/12*** | (2006.01) |
| ***A63B 21/06*** | (2006.01) |
| ***A41D 31/102*** | (2019.01) |
| ***A41D 31/12*** | (2019.01) |
| ***A41D 31/14*** | (2019.01) |
| ***A41D 31/18*** | (2019.01) |
| *A41D 13/05* | (2006.01) |
| *A63B 23/04* | (2006.01) |
| *A63B 23/12* | (2006.01) |

(52) U.S. Cl.

CPC ..... *A41D 31/04* (2019.02); *A41D 31/102* (2019.02); *A41D 31/125* (2019.02); *A41D 31/145* (2019.02); *A41D 31/185* (2019.02); *A63B 21/0601* (2013.01); *A63B 21/4005* (2015.10); *A63B 21/4007* (2015.10); *A63B 21/4011* (2015.10); *A41D 13/0512* (2013.01); *A41D 27/10* (2013.01); *A41D 2400/32* (2013.01); *A63B 23/04* (2013.01); *A63B 23/1245* (2013.01)

(58) Field of Classification Search

CPC .... A63B 23/04; A63B 23/1245; A41D 31/04; A41D 31/145; A41D 31/185; A41D 1/02; A41D 13/1245; A41D 31/102; A41D 31/125; A41D 2400/32; A41D 27/10; A41D 13/0015; A41D 13/0512; A41D 1/06; A41D 1/08; A41D 1/089; A41D 31/02; A41D 3/00; A41D 3/02

USPC ..... 2/126

See application file for complete search history.

(56) References Cited

U.S. PATENT DOCUMENTS 3,759,510 A 9/1973 Jackson, Jr.
3,777,309 A 12/1973 Yeager
4,268,917 A 5/1981 Massey
4,325,378 A 4/1982 Wilkinson
4,344,620 A 8/1982 Debski
4,382,302 A 5/1983 Watson
4,384,369 A 5/1983 Prince
4,394,012 A 7/1983 Egbert et al.
4,407,497 A 10/1983 Gracie
4,658,442 A 4/1987 Tomlinson et al.
4,684,123 A 8/1987 Fabry
4,766,613 A 8/1988 Wells
4,800,593 A 1/1989 Ruffner
4,896,881 A 1/1990 Djerdjerian
4,923,741 A 5/1990 Kosmo et al.
4,946,453 A 8/1990 Monson
4,953,856 A 9/1990 Fox, III
4,989,267 A 2/1991 Watson
5,002,270 A 3/1991 Shine
5,010,596 A 4/1991 Brown et al.
5,023,953 A * 6/1991 Bettcher ..... A41D 13/05 2/126
5,033,117 A 7/1991 Fairweather
5,048,125 A 9/1991 Libertini et al.
5,075,902 A 12/1991 McReynolds et al.
5,144,694 A 9/1992 Conrad Da oud et al.
5,182,812 A 2/1993 Goldsby
5,190,511 A 3/1993 Petree
5,205,815 A 4/1993 Saunders
5,389,168 A 2/1995 Litchholt et al.
5,503,919 A 4/1996 Litchholt et al.
5,536,553 A * 7/1996 Coppage, Jr. ..... B32B 5/26 428/102
5,553,322 A 9/1996 Cebo-Johnson
5,555,556 A 9/1996 Ozaki
5,580,342 A 12/1996 Johnson
5,659,898 A 8/1997 Bell, Jr.
5,700,231 A 12/1997 Wilkinson
5,717,999 A 2/1998 Lurry
5,728,032 A 3/1998 Glass
5,745,925 A 5/1998 Ghilardi et al.
5,755,110 A 5/1998 Silvas
5,768,706 A * 6/1998 Griffith ..... A63B 21/065 2/102
5,770,529 A 6/1998 Dennis et al.
5,797,823 A 8/1998 Gouvis, II
5,810,699 A 9/1998 Nadeau
5,842,959 A 12/1998 Wilkinson
5,893,223 A 4/1999 Glass
5,920,915 A 7/1999 Bainbridge et al.
5,937,441 A 8/1999 Raines
5,943,700 A 8/1999 Hammer et al.
5,951,446 A 9/1999 Monforte
5,978,964 A 11/1999 Gaston
6,047,405 A 4/2000 Wilkinson
6,081,924 A 7/2000 Ott
6,196,429 B1 3/2001 Cavdek et al.
6,209,135 B1 4/2001 Irvin
6,244,994 B1 6/2001 Tilberis
6,314,580 B1 11/2001 Greenberg et al.
6,364,851 B1 4/2002 Nafpliotis
6,520,926 B2 2/2003 Hall
6,557,176 B2 5/2003 Franco-Sion
6,669,608 B1 12/2003 Winston
6,671,887 B1 1/2004 Eligan et al.
6,692,413 B1 2/2004 Greenberg et al.
6,754,919 B2 6/2004 Leaphart, Jr.
6,834,396 B2 12/2004 Franco-Sion
7,000,255 B1 2/2006 Baacke
7,025,738 B2 4/2006 Hall
7,063,678 B1 6/2006 Cook
7,090,624 B1 8/2006 Chrishon
7,156,792 B2 1/2007 Gibson-Horn
7,376,979 B2 5/2008 Nilsen
7,490,361 B1 2/2009 Floyd
7,708,673 B2 5/2010 Gibson-Horn
8,245,322 B1 8/2012 Bouza
9,168,413 B2 10/2015 Petrakis et al.
9,301,554 B2 4/2016 Whaley
2002/0010058 A1 1/2002 Myrick
2002/0189003 A1 12/2002 Babcock
2003/0019010 A1 1/2003 Franco-Sion
2003/0092544 A1 5/2003 Reed
2003/0106129 A1 6/2003 Kim
2003/0177984 A1 9/2003 Newman
2004/0000003 A1 1/2004 Franco-Sion
2004/0083529 A1 5/2004 Tate
2004/0147377 A1 7/2004 Gibson-Horn
2005/0096199 A1 5/2005 Egbert et al.
2005/0227833 A1 10/2005 Wilkinson
2006/0150295 A1 7/2006 Paternoster
2007/0000015 A1 1/2007 Alaniz et al.
2007/0099775 A1 5/2007 Gibson-Horn
2007/0135279 A1 6/2007 Purdy et al.
2007/0256206 A1 11/2007 Nilsen
2007/0271965 A1* 11/2007 Kolmes ..... A41D 13/05 66/170
2007/0283479 A1 12/2007 Hasanen
2009/0044310 A1 2/2009 Baacke
2009/0139005 A1 6/2009 Whaley
2009/0181588 A1* 7/2009 Capwell ..... D06M 11/44 442/64
2009/0227162 A1 9/2009 Kruckenberg et al.
2010/0010568 A1 1/2010 Brown
2010/0064413 A1 3/2010 Koelle et al.
2010/0071113 A1 3/2010 Hamilton et al.
2010/0144490 A1 6/2010 Purdy et al.
2010/0218300 A1 9/2010 Alaniz et al.
2010/0248915 A1 9/2010 Gibson-Horn
2010/0311551 A1 12/2010 Winston
2011/0009713 A1 1/2011 Feinberg
2011/0072551 A1 3/2011 Roberts

(56) References Cited

U.S. PATENT DOCUMENTS

| | | | | |
|---|---|---|---|---|
| 2011/0231986 | A1* | 9/2011 | Waldie | A41D 13/0015 2/456 |
| 2011/0274903 | A1 | 11/2011 | Stuart et al. | |
| 2013/0085040 | A1* | 4/2013 | Bowers | A63B 21/0552 482/8 |
| 2013/0298301 | A1* | 11/2013 | Petrakis | A63B 21/4011 2/69 |
| 2013/0298302 | A1* | 11/2013 | Whaley | A63B 21/4005 2/69 |
| 2018/0111016 | A1 | 4/2018 | Brockway, Jr. et al. | |
| 2019/0022450 | A1 | 1/2019 | Martinoli Sanz | |

OTHER PUBLICATIONS

Extended European Search Report for European Patent Application No. 13182480.7, dated Apr. 7, 2014, in 8 pages.
U.S. Appl. No. 16/506,783, filed Jul. 9, 2019, Petrakis et al.

* cited by examiner

BREATHABLE HEAVYWEIGHT GARMENTS FOR PHYSICAL CONDITIONING

BACKGROUND

Field

This disclosure relates generally to heavyweight garments for physical conditioning.

Description of the Related Art

Heavyweight garments may have benefits for physical condition, e.g., by providing a increased "load" on various systems of the human body and/or by increasing the wearer's effective body weight. The very weight and bulk of such garments, however, can make the use of such garments difficult. Garments disclosed herein address various challenges related to heavyweight garments, including their use for physical conditioning.

SUMMARY

Figure 1A:
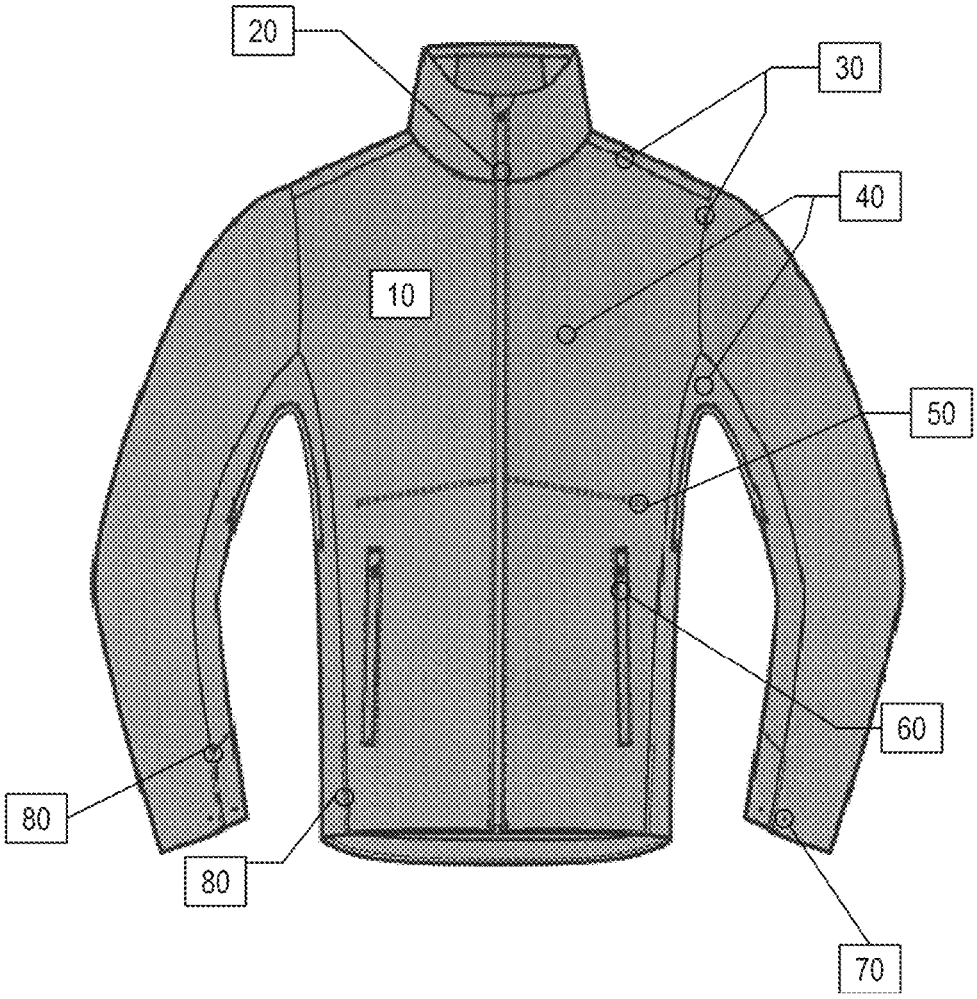
FIG. 1A depicts an example of a front view of a heavyweight jacket according to some embodiments.

In some embodiments, a heavyweight jacket is provided. The jacket comprises a main body configured to fit on a torso of a wearer and one or more sleeves configured to fit on an arm of the wearer. The one or more sleeves are detached from the main body. The main body and one or more sleeves are formed of fabric having a uniform density of 8 or more ounces per square yard.

In some other embodiments, a heavyweight garment is provided. The heavyweight garment is formed of fabric having a uniform density of 8 or more ounces per square yard. The fabric is formed of two or more pre-bonded layers of material with at least an innermost layer and an outermost layer. The fabric is also permeable to water vapor and has a moisture vapor transmission rate (MVTR) between about 100 g/m$^2$/day and about 1,500 g/m$^2$/day.

In some other embodiments, a heavyweight sleeve is provided. The heavyweight sleeve is configured to fit on an arm of a human wearer. The sleeve is formed of pre-bonded fleece fabric and tapers from one open end to an opposite open end. The sleeve's inside face (the face proximate to the torso of the wearer) is thinner than the outer face (the face distal to the torso of the wearer). The sleeve has a MVTR between about 100 g/m$^2$/day and about 1,500 g/m$^2$/day.

Additional example embodiments are provided below.

In some aspects, a heavyweight garment has a total weight of 2-15 pounds and is formed of fabric. The weight is evenly distributed, without separate weights, across at least sections of the fabric representing more than about 40% of the garment surface area.

In some embodiments, the garment provides sufficient ventilation that a human could safely exert himself under room temperature conditions without overheating.

In some embodiments, the total weight of the garment is about 3-10 pounds.

In some embodiments, the total weight is about 2-9 pounds.

In some embodiments, the total weight is about 3-8 pounds.

In some embodiments, the total weight is about 4-8 pounds.

In some embodiments, the total weight is about 6-8 pounds.

In some embodiments, the fabric has a MVTR of between about 100 g/m$^2$/day and about 1,500 g/m$^2$/day.

In some embodiments, the MVTR is between about 500 g/m$^2$/day and about 1,000 g/m$^2$/day.

In some embodiments, the weight is fully evenly distributed across the material forming the garment.

In some embodiments, a majority of the weight is in the patches of fabric representing no more than about 40% of the fabric surface area.

In some embodiments, the patches occupy about 50% of the total surface area of the garment.

In some embodiments, the patches occupy about 60% of the total surface area of the garment.

In some embodiments, the patches occupy about 70% of the total surface area of the garment.

In some embodiments, the garment is a jacket.

In some embodiments, the garment is pair of pants.

In another aspect, a heavyweight garment is formed of a fabric having a density of greater than 14 oz/yd$^2$, and without metal integrated with the fabric, other than fasteners.

In some embodiments, the total weight of the garment is about 2-15 pounds.

In some embodiments, the total weight is about 3-10 pounds.

In some embodiments, the total weight is about 2-9 pounds.

In some embodiments, the total weight is about 3-8 pounds.

In some embodiments, the total weight is about 4-8 pounds.

In some embodiments, the total weight is about 6-8 pounds.

In some embodiments, the fabric has a MVTR of between about 100 g/m$^2$/day and about 1,500 g/m$^2$/day.

In some embodiments, the MVTR is between about 500 g/m$^2$/day and about 1,000 g/m$^2$/day.

In some embodiments, the weight is fully evenly distributed across the material forming the garment.

In some embodiments, a majority of the weight is in the patches of fabric forming the sections of the separate representing no more than about 40% of the fabric surface area.

In some embodiments, the patches occupy about 50% of the total surface area of the garment.

In some embodiments, the patches occupy about 60% of the total surface area of the garment.

In some embodiments, the patches occupy about 70% of the total surface area of the garment.

In some embodiments, the garment is a jacket.

In some embodiments, the garment is pair of pants.

In yet another aspect, a heavyweight garment is formed of a fabric having a density of greater than 14 oz/yd$^2$, and sufficient ventilation that a human could safely exert himself under room temperature conditions without overheating.

In some embodiments, the total weight of the garment is about 2-15 pounds.

In some embodiments, the total weight is about 3-10 pounds.

In some embodiments, the total weight is about 2-9 pounds.

In some embodiments, the total weight is about 3-8 pounds.

In some embodiments, the total weight is about 4-8 pounds.

In some embodiments, the total weight is about 6-8 pounds.

In some embodiments, the fabric has a MVTR of between about 100 g/m$^2$/day and about 1,500 g/m$^2$/day.

In some embodiments, the MVTR is between about 500 g/m$^2$/day and about 1,000 g/m$^2$/day.

In some embodiments, the weight is fully evenly distributed across the material forming the garment.

In some embodiments, a majority of the weight is in the patches of fabric forming the sections representing no more than about 40% of the fabric surface area.

In some embodiments, the patches occupy about 50% of the total surface area of the garment.

In some embodiments, the patches occupy about 60% of the total surface area of the garment.

In some embodiments, the patches occupy about 70% of the total surface area of the garment.

In some embodiments, the garment is a jacket.

In some embodiments, the garment is pair of pants.

DETAILED DESCRIPTION

Weighted garments may be used while exercising or as a wearer goes about their day to improve the wearer's physical fitness and their health. Weighted garments can increase the wearer's muscle strength, cardiovascular health, and bone density and can improve other metrics of health, such as blood pressure or cholesterol levels. Athletes can use weighted garment conditioning to improve their performance. The elderly and the infirm can use weighted garment conditioning to restore and develop their physical health. Weighted garment conditioning may also facilitate higher levels of compliance than other exercise regimes because putting on a set of garments is simpler and faster than, for example, driving to a gymnasium.

To provide a desired garment weight, some garments use discrete metal weights attached to the garments or otherwise incorporate metal into the fabric. Such designs, however, suffer from various deficiencies. One deficiency is that the weight provided by discrete weights is unevenly distributed throughout the fabrics. Moreover, thick, inflexible materials may be used to form the garments and to support the attached weights, and the weights themselves may limit the flexibility of the garment. The uneven weight distribution and lack of flexibility undesirably make such garments uncomfortable to wear and awkward to move in.

Weighted garments that use fabric to increase their weight may also have flaws. A heavy, contiguous garment may put a wearer at risk of hyperthermia because it may lack sufficient breathability. Such garments may restrict the wearer's flexibility because the fabric may be too thick at the wearer's joints, or in other locations. The garments may also simply be too heavy or too rigid for an elderly or infirm person to easily put on. For example, the rigidity of the sleeves of a heavyweight jacket may make it difficult for an elderly or infirm person to reach back and then fit their arms through the sleeves.

Fabric surrounding the wearer's shoulder joint can present special problems. Over 50% of the United States population suffers from rotator cuff injuries. Many of those injured persons would benefit by wearing a weighted conditioning garment, yet many conditioning garments apply significant pressure to the shoulder area due to the garment's "drape." This pressure may be uncomfortable to the wearer may discourage users from wearing the weighted garments at all, or from wearing the garments for as long as desired to complete a particular conditioning regime. Thus, a heavy, flexible, breathable garment that does not pressure sensitive regions and that is easy to put on may advantageously significantly improve the health of the wearer.

In some embodiments, heavyweight garments are provided that are comprised of heavyweight fabric, as opposed to a fabric with metal or other discrete weights attached to or otherwise incorporated into the fabric. Because the weight is provided by the material of the fabric itself, the weight may be more evenly distributed throughout the garment, thereby providing a more comfortable garment for a wearer. Preferably, the fabric is a woven or knit fabric, and is flexible such that it does not excessively restrict a wearer's freedom of movement. Further, in some embodiments, the heavyweight garment may be porous, which allows the garment to be breathable and may reduce heat retention and allow air to pass into and moisture to pass out of the garment. Advantageously, the heavyweight garment may function as a "second skin" that allows the user to exercise or perform everyday tasks as a heavier individual, thereby improving their physical conditioning. The breathability and flexibility of the garment may allow the wearer to wear the garment for extended durations (e.g., about an hour or about two hours) without causing dangerous adverse physical conditions in the user (e.g., heat exhaustion). For example, an average human male might be able to wear the garment for a period of 2 hours at room temperature while walking at a constant pace of 3.1 miles per hour without suffering from hyperthermia.

In some embodiments, the total weight of the garment may be about 2-15 pounds, about 3-10 pounds, about 2-9 pounds, about 3-8 pounds, about 4-8 pounds, about 6-8 pounds, or 6-10 pounds. The garment may be any garment worn by an individual, e.g., a jacket and/or pants. In some embodiments, the garment may be contiguous, e.g., a jacket having a main body that fits the torso of a wearer and having sleeves attached to the main body, or pants. More preferably, in some embodiments, the garment may be a jacket having a main body and sleeves that are completely detached from or not contiguous with the main body. In some embodiments, the weight of the pants may be on the lower end of the above-noted ranges. In some embodiments, the weight of a pair of pants may be between about 1 pound and about 6 pounds. In some embodiments, the pair of pants may weigh about 3 pounds, about 4 pounds, or about 5 pounds.

In some embodiments, the weight per unit area (also referred to as density herein) of the heavyweight fabric forming the garment is about 14 or more ounces/square yard, 16 or more ounces/square yard, 18 or more ounces/square yard, 20 or more ounces/square yard, 22 or more ounces/square yard, or 44 or more ounces/square yard. In some embodiments, the weight per unit area of the heavyweight fabric is between 8 and 50 ounces/square yard, between 10 and 18 ounces/square yard, or between 22 and 44 ounces/square yard. In some embodiments, the fabric forming the garment is a woven or knit fabric with sufficient porosity to allow the passage of air and/or moisture, thereby making the fabric breathable. In some other embodiments, the fabric forming a garment may include a non-porous heavyweight material, such as a high-density polymer layer.

The fabric may be formed of a synthetic (e.g., polymer material) and preferably does not have metallic components, which may provide advantages for flexibility. In some embodiments, the fabric may be formed from textile fibers that include, without limitation, one or more of nylon, polyester, or spandex. The fabric may be produced through weaving, knitting, or felting of the fibers. In some embodiments, the fabric is a fleece fabric.

In some embodiments, the garment is non-metallic except for hardware such as zippers. For example, less than about 50%, about 60%, about 70%, about 80%, about 90%, or about 95% of the weight of the garment may be due to metallic components in or attached to the fabric. Rather, the weight of the garment is preferably substantially due to the fabric, thereby allowing for a more even distribution of weight over the expanse of the garment formed of that fabric.

As discussed herein, the garment's fabric may include one or more layers of material. For example, the fabric may include 3 or more layers, 4 or more layers, or 6 or more layers of material. In some embodiments, all of these layers are porous and breathable as discussed herein. In some embodiments, one or more of these layers may not be porous. For example, a nonporous layer could be constructed from high-density polymer. Thus, the garment may include different fabrics of different thicknesses and breathability at different locations.

Optionally, the various layers may be bonded or laminated together (e.g. with adhesive attaching the neighboring layers to one another) to form a unitary fabric. Bonding the layers together with adhesive can increase the fabric's weight. In some embodiments, the adhesive used to bond the layers of material together may make up about 10% or more, about 15% or more, about 20% or more, about 25% or more, about 30% or more, or about 35% or more of the weight of the fabric per unit area (e.g., per square foot, or per square yard). In addition, in some embodiments, the adhesive makes up no more than about 40%, or no more than 30% of the weight of the fabric. In some embodiments, the adhesive may form a layer sufficiently thick to achieve the weights noted above. Examples of adhesives include polyvinyl acetate based adhesives, latex adhesives, and other adhesives suitable for bonding layers of material into fabrics. Advantageously, using adhesive to increase the fabric's weight may simplify fabric construction and allow the use of fabric with fewer constituent layers of material.

The layers may be "pre-bonded" together during the fabric manufacturing process. "Pre-bonded fabric" means fabric whose layers of material are bonded together during the fabric manufacturing process and therefore before construction of the garment. For instance, after weaving, knitting, or felting a single layer of material, a fabric manufacturer could then bond or laminate two or more layers of the same or different material together. Thus, some or all of the garment may be constructed of pre-bonded fabric. Some or all of the garment may even be constructed of multiple layers of pre-bonded fabric. Alternatively, the layers may be bonded or laminated together after the fabric manufacturing process is complete.

In some embodiments, the fabric used to construct the heavyweight garment is of "uniform density." Uniform density means that the density of the fabric is substantially uniform over the entire area of the fabric. For example, every square inch of the fabric may have substantially the same density (e.g. differing by less than 15%) over the entire area of the fabric.

In some embodiments, multiple layers of thick, pre-bonded fabric may be used in portions of the garment that need not be substantially flexible, such as the front and back of a jacket or the thigh portion of a pair of pants. Thinner layers may be used to form the sides and armpits of a jacket or the rear face of a pair of pants. Thinner layers may also be used around a jacket's collar and on the inside of a jacket's sleeves. Alternatively, a more flexible fabric may be used to increase flexibility in lieu of a thinner layer. The more flexible fabric may be thicker, of equal thickness, or thinner than the other fabric layers.

In some embodiments, the multilayered heavyweight garments include at least one layer that is an air permeable membrane. This membrane may also include some resistance to the penetration of external moisture. In combination with the porosity and the density of the fabric, this air permeable membrane can provide a heavyweight garment that is breathable (air and moisture can pass through the fabric). In some embodiments, the multilayered garments comprise at least one layer formed from a polymer that is impermeable to air or water such as a hard polymer.

Preferably, however, the heavyweight garment is porous. In some embodiments, the heavyweight fabric of the garment has sufficient porosity that moisture vapor can pass through the garment. For example, the heavyweight fabric may have a moisture vapor transmission rate (MVTR) between about 100 $g/m^2/day$ and about 1,500 $g/m^2/day$. In some embodiments, the MVTR is between about 500 $g/m^2/day$ and about 1,000 $g/m^2/day$. In some embodiments, the entire fabric has sufficient porosity that its permeability rate is between about 1,000 and about 4,000 mm/s. In some embodiments, the permeability rate is between about 1,500 and about 3,500 mm/s. In some embodiments, the permeability rate is between about 2,000 and about 3,000 mm/s. Any embodiments of the garments described herein may have a MVTR or permeability rate as described above. It will be appreciated that the MVTR or permeability rate describe the transmission rate or permeability of fluid through the garment, e.g., from an interior to an exterior of the garment or visa versa.

Some embodiments of the garment may include a ventilation system comprising openings in the garment. The ventilation system's openings may take various forms. For instance, the garment may contain vents, e.g., zippered vents, at the wearer's armpits or at other at other locations where relatively high heat retention may occur and/or where additional moisture transmission is desired. The garment may contain flaps secured by buttons or VELCRO® that allow ventilation when "open" but block ventilation when "closed." The garment may even contain detached sections, such as detached sleeves, which could provide perfectly open ventilation in the opened region near or about the wearer's armpits, shoulders, and upper arms. The ventilation system may also comprise many smaller openings, such as those found in a porous fabric.

In some embodiments, the entire garment is formed of heavyweight fabric. In other embodiments, most of the jacket (e.g., more than about 50%, about 60%, about 70%, about 80%, about 90%, or about 95% of the weight of the garment) is formed of the heavyweight fabric. In some embodiments, selected portions of the garment may be provided with increased weight by attaching patches of heavyweight fabric to those portions. The patches of heavyweight fabric may be formed from pre-bonded fabric or not. The additional weight provided by the patches may be evenly distributed across each patch and the patches may represent a substantial portion of the overall garment area, such as greater than 40%, greater than 50% or greater than 60% of the garment area. In some embodiments, the heavyweight fabric may be attached as patches to a garment made of lower weight fabric.

Reference will now be made to the figures in which like reference numerals refer to like parts throughout.

The heavyweight garment may be any garment worn by an individual or wearer; that is, a human being. In some embodiments, the heavyweight garment may be a heavyweight jacket as shown in FIGS. 1A, 1B, 1C, 2, 3A, 3B, and 4. In some embodiments, the heavyweight jacket may simply be one or more sleeves configured to fit on the arm of the individual wearer. In some other embodiments, the heavyweight garment may be a pair of heavyweight pants as shown in FIGS. 5.

Figure 1B:
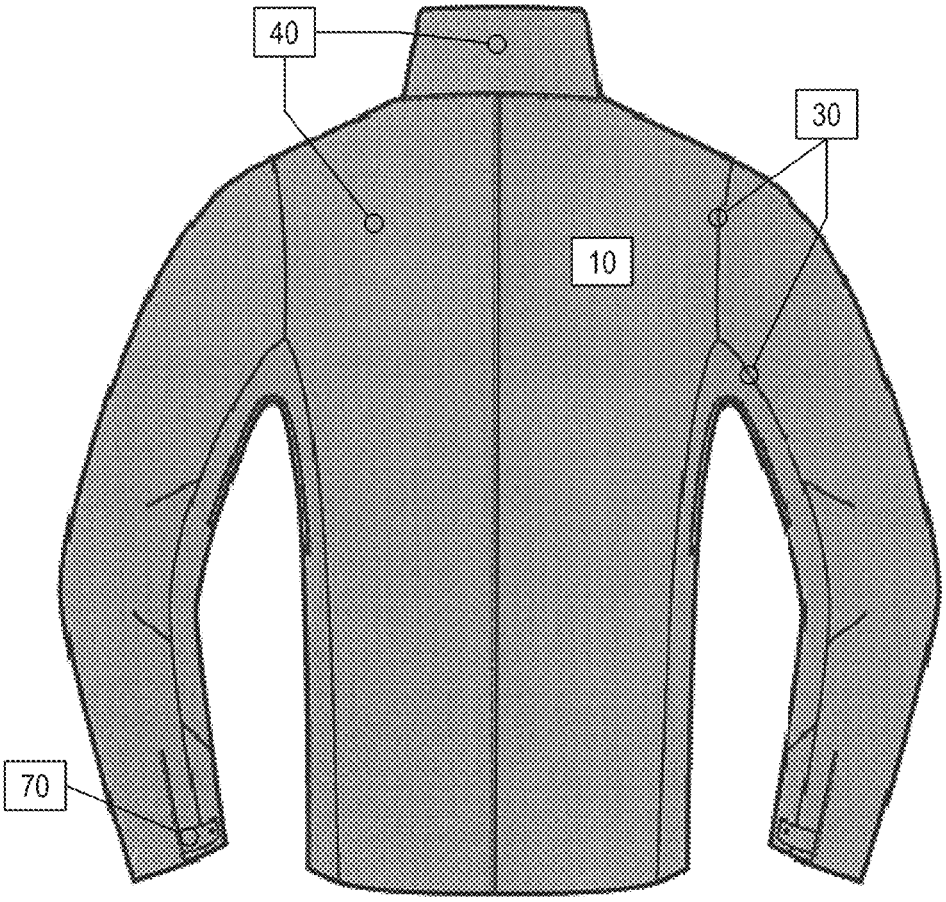
FIG. 1B depicts an example of a back view of the jacket of FIG. 1A according to some embodiments.
Figure 1C:
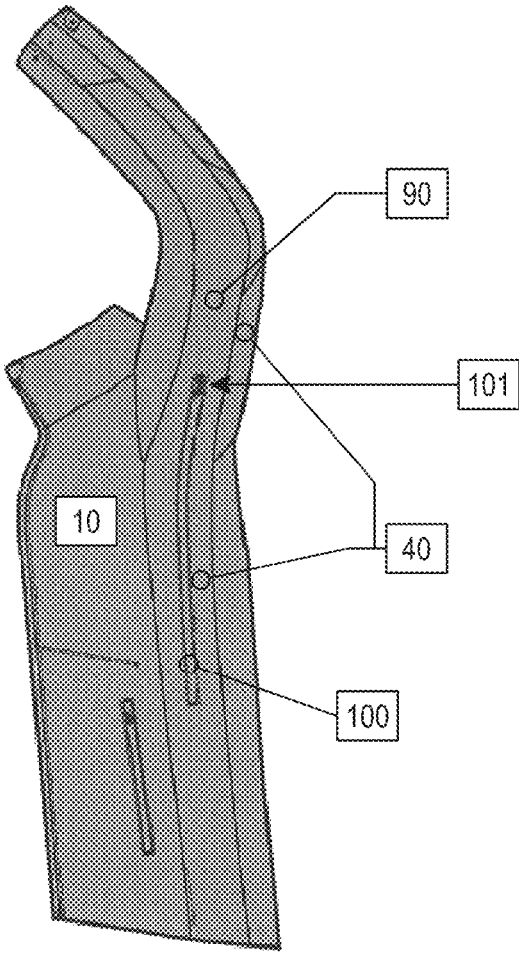
FIG. 1C depicts an example of a side view of the jacket of FIG. 1A according to some embodiments.

Referring to FIGS. 1A-1C, in some embodiments, the heavyweight jacket (10) may be made of heavyweight fabric (40). For example, the heavyweight fabric (40) may be a fleece fabric, such as a power stretch fleece. The fleece fabric may be formed from nylon, polyester, and/or spandex. The fleece fabric may be comprised of one or multiple layers. Those layers may be pre-bonded. In FIGS. 1A-1C, the weight of the jacket is distributed evenly by using the same heavyweight fabric throughout the jacket.

The jacket (10) may optionally have various other functional and/or cosmetic features. For example, a closing mechanism, such as a zippered opening (20), may be provided on the front of the jacket (10). In addition, the jacket (10) may include side pocket zippers (60). The jacket may also have a top stitch detail that lines the upper portion of the side pocket (50) and a reinforced top stitch detail on the lower arm and lower jacket regions (80). The jacket (10) may have an overlocking seam in the shoulder region of the jacket (30) and a bonded cuff with under-snap cuff adjusters on the sleeve (70). Referring to FIG. 1C, the jacket may have a panel on the arm (90) to facilitate ease of movement of that arm.

As disclosed herein, preferably the heavyweight fabric (40) is breathable, although it is also contemplated that the fabric (40) may be nonporous in some embodiments. To increase ventilation of the breathable garment fabric and/or to provide ventilation in a garment formed a nonporous fabric, one or more vents may be provided in the jacket (10). Referring to FIG. 1C, the jacket (10) may include one or more vents (100). In some embodiments the vent(s) (100) may be a section of fabric which is porous or otherwise open. In some other embodiments, the vent(s) (100) may include a closure that allows the vent(s) (100) be selectively opened and closed. In some embodiments, the vent(s) may be opened and closed through use of closure that is a zipper (101).

Figure 2:
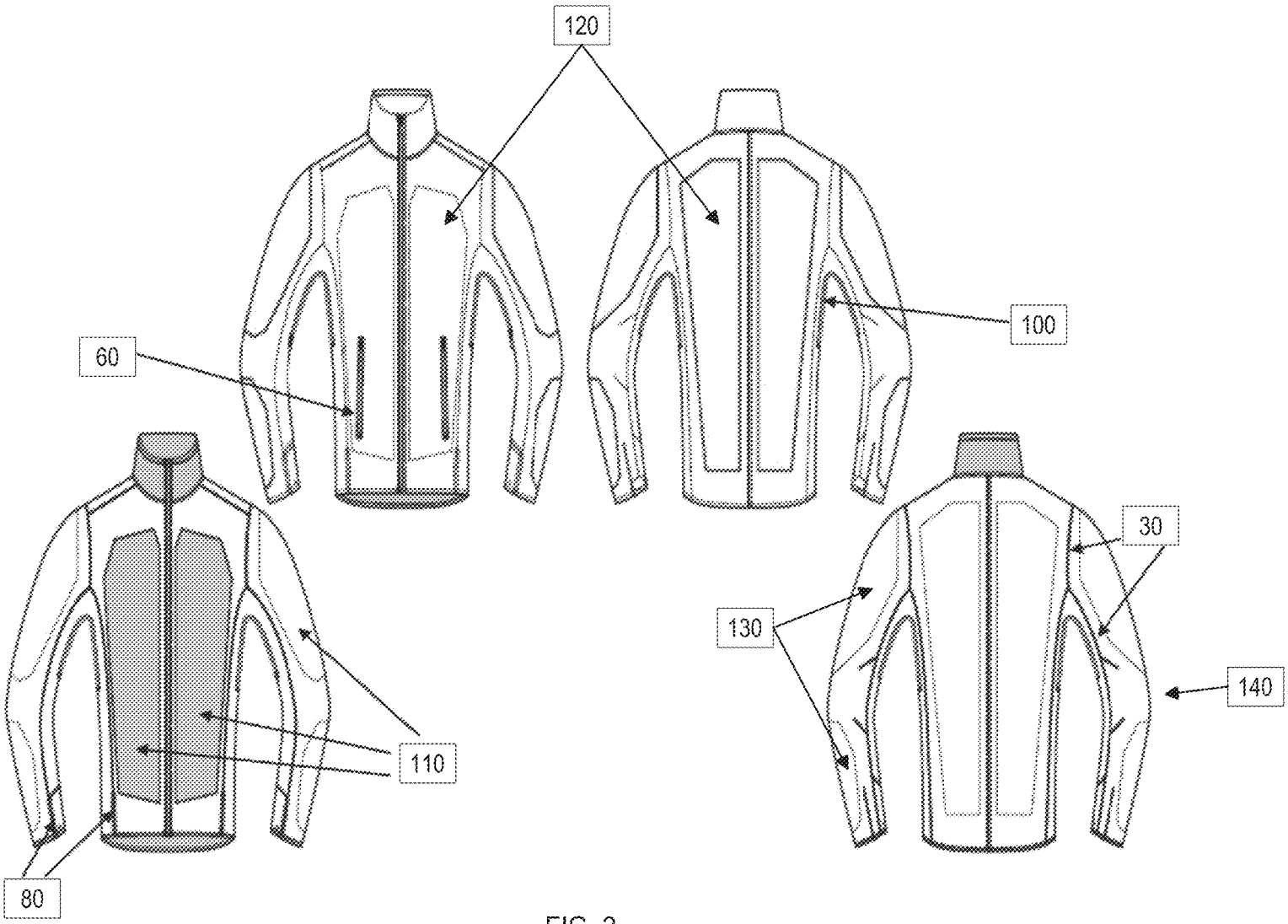
FIG. 2 depicts examples of various views of a heavyweight jacket with patches of heavyweight fabric according to some embodiments.

As shown in FIG. 2, the weight of the heavyweight garment may also be augmented with patches of heavyweight fabric (40). Patches (110) in the form of heavyweight fabric may be placed in different regions of a jacket. The distributed patches may supply greater than or equal to 30% of the jacket weight, greater than or equal to 40% of the jacket weight, greater than or equal to 50% of the jacket weight, or greater than or equal to 60% of the garment weight. In some other embodiments, a majority of the weight of the heavyweight jacket may be provided by a single run of the heavyweight fabric (40) itself. For example, patches may supply less than 40%, less than 30%, or less than 20%, of the total weight of the heavyweight jacket in some embodiments. The patches may be attached by being sewn, bonded, or laminated into the underlying jacket fabric. Thus the patches could be attached on the exterior of the jacket, in between outer and an inner layers of material forming the jacket, or on the inner face of the jacket. The underlying jacket fabric may comprise the heavyweight fabric (40) or a lighter weight fabric. In some embodiments, the patches may be one or more additional layers of fabric (e.g., one or more layers of fleece fabric) attached to the underlying jacket fabric. The patches may be layered on top of other patches. The patches may even be constructed from pre-bonded fabric.

As illustrated, patches (110) are located on regions of the jacket that do not substantially limit the flexibility of a wearer. For example, relatively large patches (120) are located on the front and back of the jacket's torso but not on the jacket's sides. Smaller patches (130) are located on the outer faces (140) of the sleeves of the jacket. These smaller patches (130) are arranged so that a wearer may freely bend their elbows and rotate their shoulders.

Figure 3A:
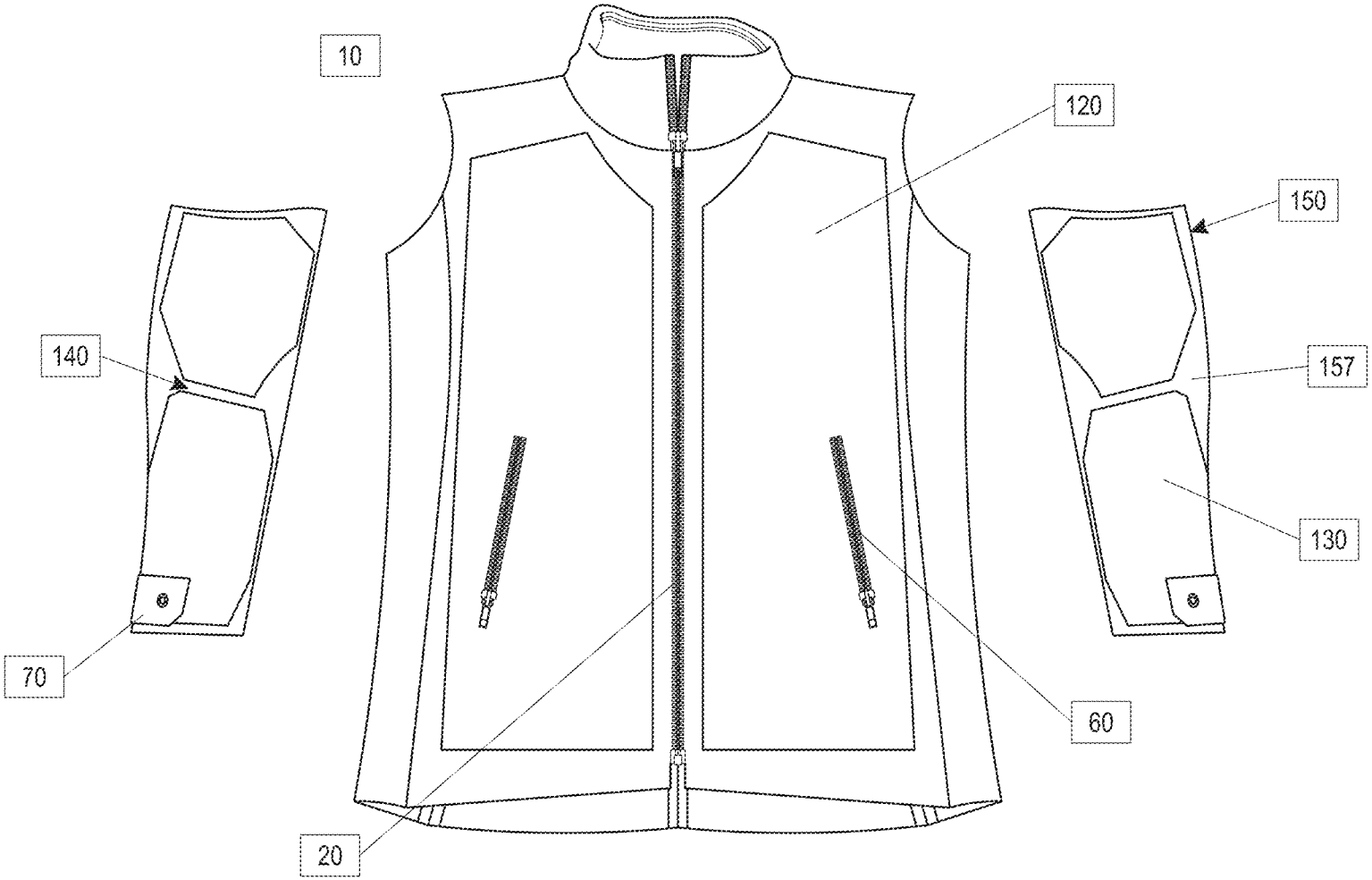
FIG. 3A depicts a view of a heavyweight jacket with detached sleeves according to some embodiments.
Figure 3B:
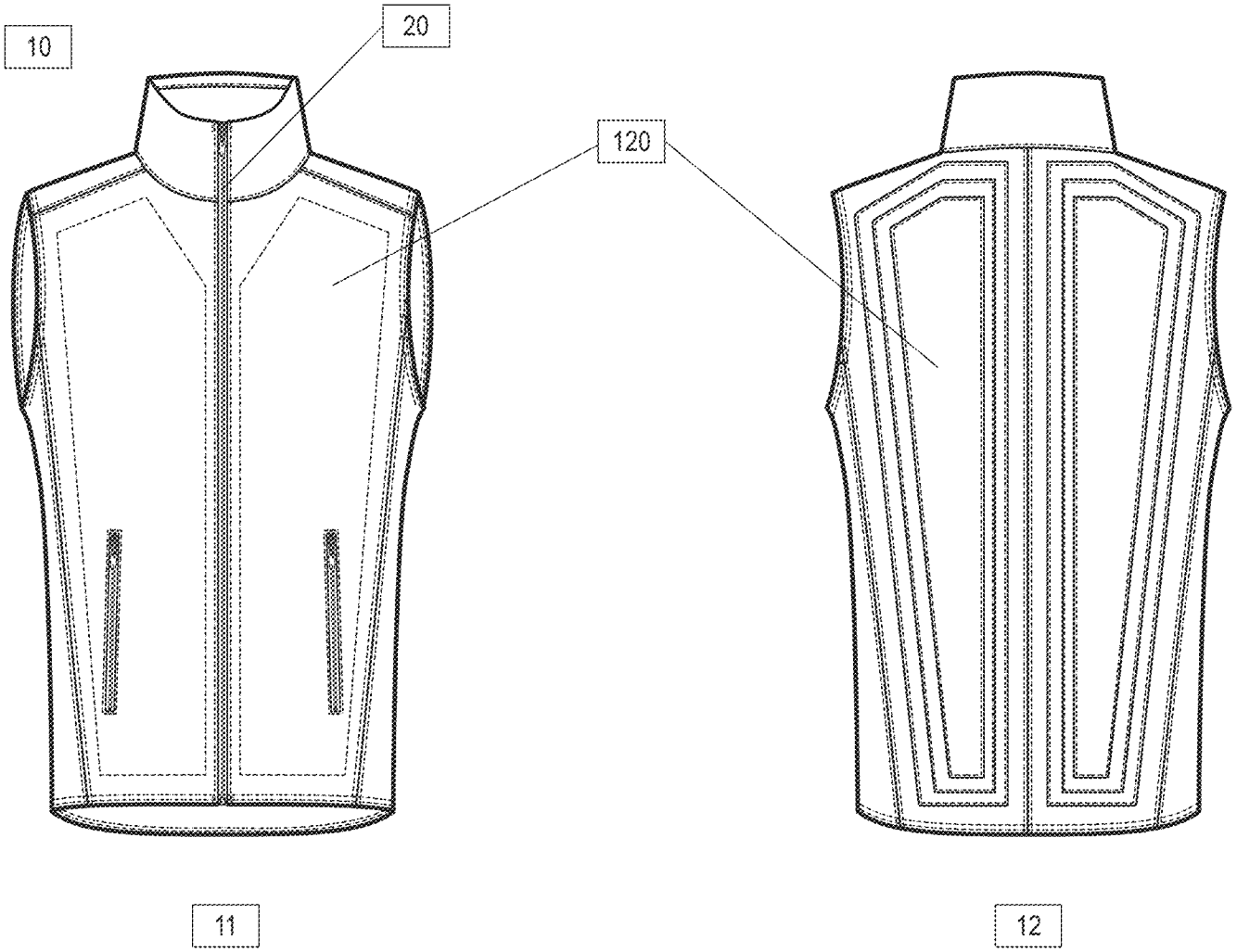
FIG. 3B depicts examples of various views of a heavyweight jacket with detached sleeves according to some embodiments.
Figure 4:
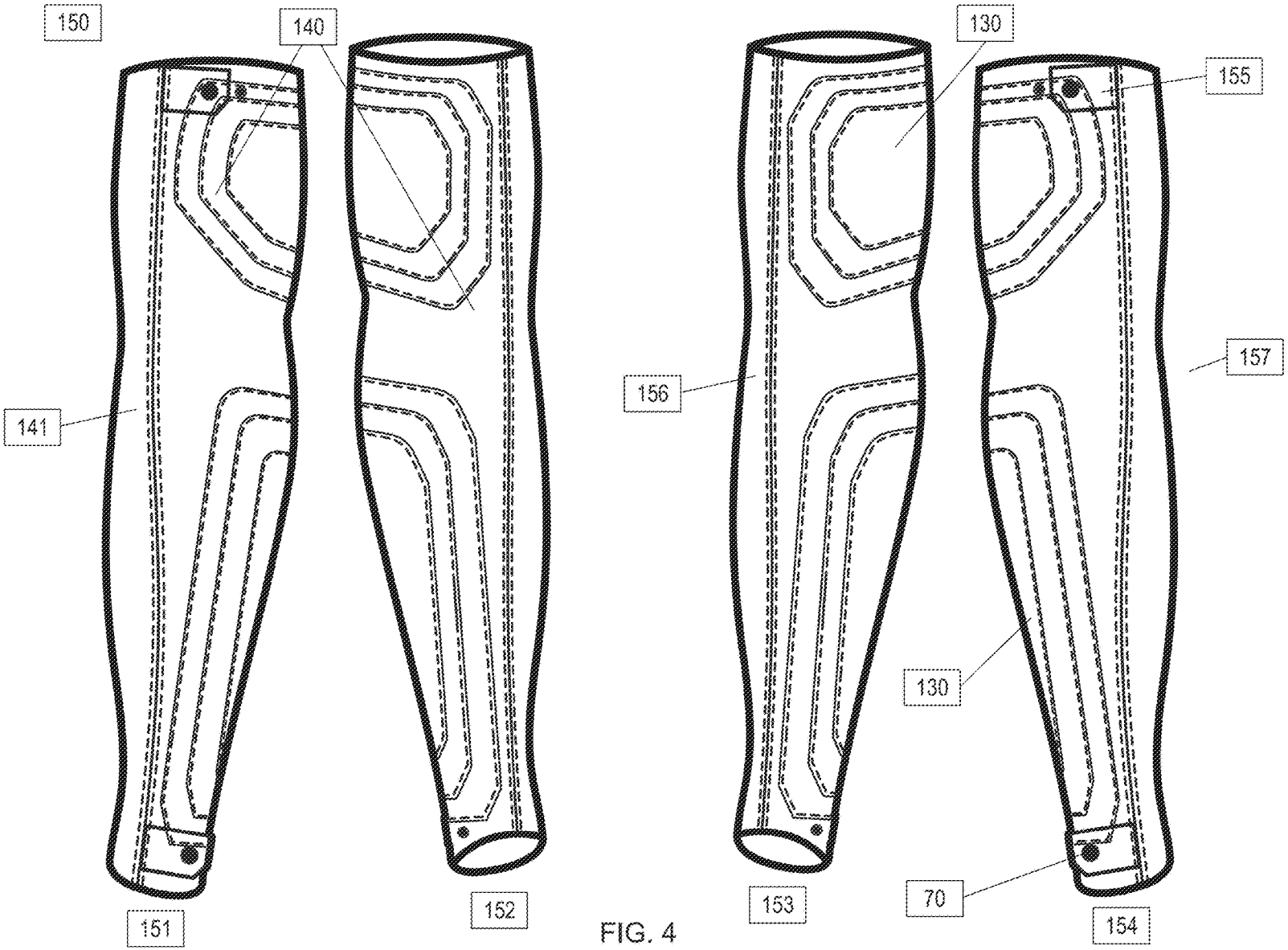
FIG. 4 depicts examples of various views of a pair of detached sleeves according to some embodiments.
Figure 5:
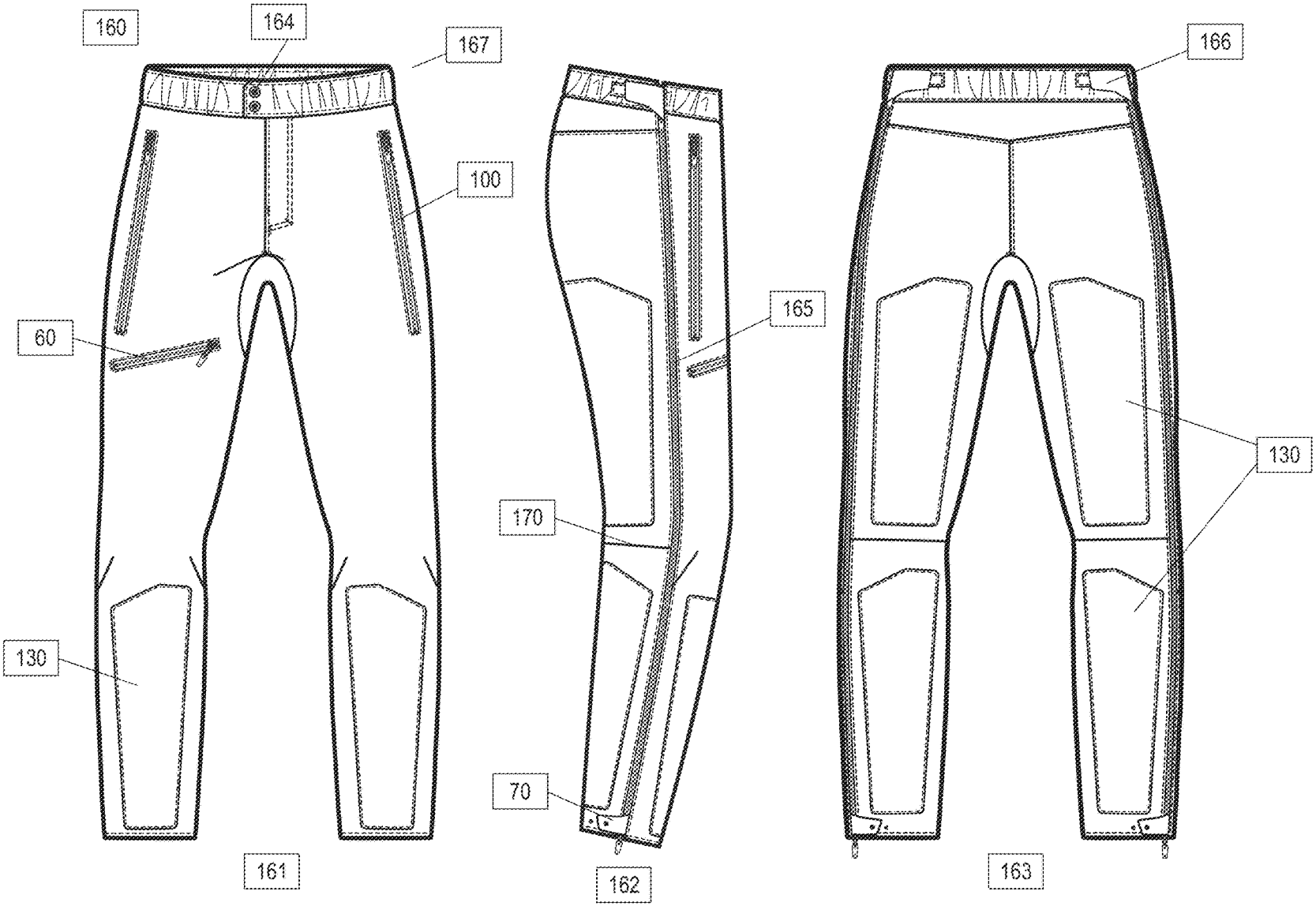
FIG. 5 depicts examples of various views of a pair of heavyweight pants according to some embodiments.

Referring to FIGS. 3A, 3B and 4, the heavyweight garment may also be a jacket (10) with detached sleeves (150). FIG. 3A shows the jacket (10) and detached sleeves (150). FIG. 3B includes a front view (11) and a rear view (12) of the main body of the jacket (10). FIG. 4 includes a rear view (151) and a front view (152) of a right detached sleeve. FIG. 4 also includes a front view (153) and a rear view (154) of a left detached sleeve.

FIG. 4 shows that each detached sleeve (150) may have at least two faces, an "outer face" (140) and an "inner face" (141). The "outer face" (140) comprises the face of the detached sleeve (150) that is distal to the wearer's body, when worn by a wearer. The "inner face" (141) comprises the face of the detached sleeve (150) that is proximate to the wearer's body, when worn by a wearer. The outer face (140) and the inner face (141) of each detached sleeve are joined by seams (156).

In one embodiment, the portion of the jacket (10) configured to fit on the torso of an individual (which may also be referred to as the torso of the jacket) may weigh approximately 3.5 lbs. In one embodiment, the detached sleeves (150) configured to fit on the arm of a wearer may weigh approximately 2 lbs each. In other embodiments the various pieces of the jacket (10) and detached sleeves may have different weights. The detached sleeves (150) and the torso of the jacket (10) may be worn together or separately.

The construction of the jacket (10) is substantially similar to the construction of the jacket shown in FIG. 2. However, the zippered vents (100) may be omitted in this embodiment because the detached sleeves (150) provide an open gap towards the upper arm of the wearer, between the upper portion of the sleeve and the torso of the jacket (10). It will be appreciated that the gap itself allows ventilation.

The construction of the jacket (10) may further comprise a pair of detached sleeves (150) that have a releasable closure (not shown). For example, a strap that extends between and connects the jacket (10) and a detached sleeve (150) while still leaving an open gap between the connected jacket (10) and a detached sleeve (150). The releasable closure (not shown) may be capable of releasably attaching and detaching from the torso of the jacket (10). The releasable closure (not shown) may comprise one or more buttons on straps (not shown) with corresponding button holes (not shown) on the torso of the jacket (10). The releasable closure (not shown) could also comprise male snaps on straps (not shown) with corresponding female snaps on the torso of the jacket (10). Other releasable closures may also be used.

Like the sleeves FIGS. 1 and 2, the detached sleeves (150) are tapered from one open end to an opposite open end of the sleeves (150). The detached sleeves are wider close to the wearer's shoulders than at the opening proximate the wearer's hands. The narrowest point is close to the wearer's wrists in some embodiments. The detached sleeves (150) may also be shaped in some embodiments so that they narrow near the wearer's elbow joint (157). Tapering and shaping in this fashion provides may provide one or more advantages over barrel shaped sleeves, including helping the sleeves fit the wearer's limb and providing for a "friction fit." The detached sleeves (150) also have clasps (155) at the top of each sleeve, which further assist the 'friction fit.'

The detached sleeves (150) are formed from multiple different fabrics. The outer faces (140) of the detached sleeves (150) are formed from multiple layers of pre-bonded fleece. The inner faces (141) are formed from a single layer of pre-bonded fleece. In some embodiments, the detached sleeves (150) also have patches (130) on the outer face. The patches (130) may be single patches or even multiple patches layered on top of one another.

Referring to FIG. 5, the heavyweight garment may also be a pair of pants (160). FIG. 5 shows a front view (161), a side view (162), and a rear view (163) of a pair of pants (160). The pair of pants (160) may comprise any of the fabrics used for the jacket (10). For example, the pair of pants (160) may be formed of a fleece fabric (40) such as a power stretch fleece fabric. The pair of pants (160) may also be formed of a variety of different fabrics, including fabrics with greater elasticity than a power stretch fleece material. In one embodiment, the pair of pants (160) may be formed from a flexible elastic base fabric, such as elastane. Patches (130) of heavyweight fabric (40) can then be added to augment the pants' (160) weight. In another embodiment, the pants (160) may be formed from the heavyweight fabric (40) with optional patches (130) to further increase garment's weight.

The pants (160) may include an elastic waistband (167) and various side pockets (50). A metal snap (164) may be used to fasten the waist of the pants (160). The pants (160) may include zippers (165) down the outside face of the pants legs. There may be a tab (166) on the wearer's waist that can tighten or loosen the pants. There may also be under-snap cuff adjusters (70) at the end of each leg. The pants (160) may also include vents (100) along the sides of the pants and proximate the hips of a wearer.

The pants may further include patches (130) that increase weight without substantially limiting flexibility. The patches (130) may appear on the rear face of the pair of pants and avoid the region surrounding the wearer's knee joint (170). The patches (130) may also appear on the front face of the pants, in the region near the wearer's shins. The patches may be single patches or layered patches.

Figure 6A:
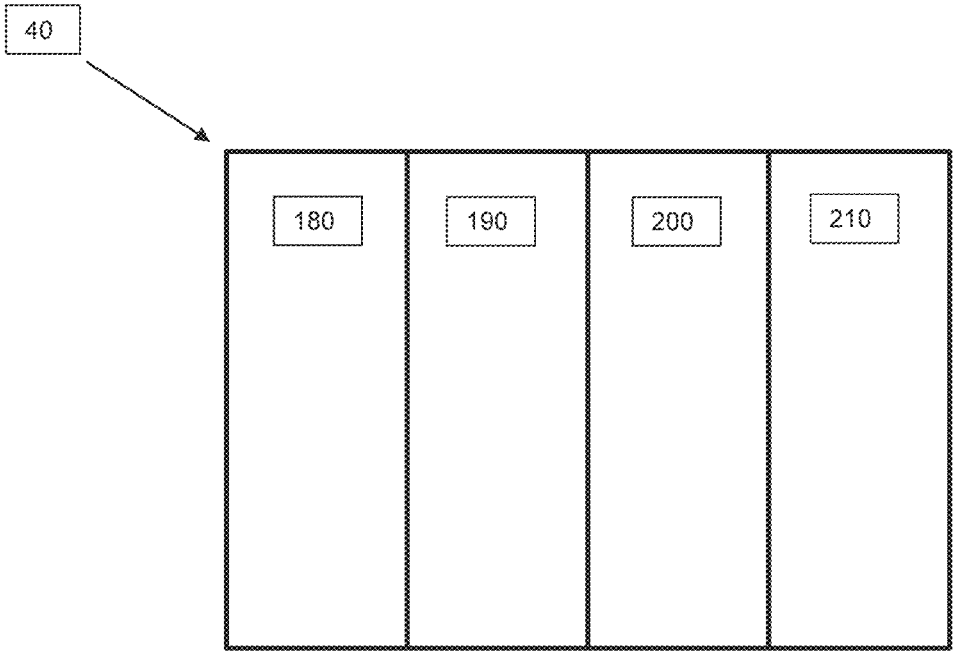
FIG. 6A depicts an example of a cross-sectional view of a heavyweight fabric construction according to some embodiments.

Described below are various examples of a heavyweight fabric comprising multiple layers. Referring to FIG. 6A, the heavyweight garments may comprise 4 or more layers: an innermost layer (180), an outermost layer (210), and two middle layers (190) and (200). In some embodiments, the innermost layer (180) may comprise a liner material such as a gridded fleece that enhances wicking action (removing moisture from the skin) and that allows moisture and air to pass through the layer. However, other heavy, flexible materials besides a gridded fleece may also be suitable.

One of the other layers may comprise a fleece material. In some embodiments the outermost layer (210) and one of the middle layers (190) or (200) may be formed of a flexible fleece material. The fleece material may be comprised of nylon, spandex, or polyester. The material forming the outermost layer (210) and the one of the middle layers (190) or (200) may be formed of the same fleece material or of a different fleece material. Those layers may also be formed from a different, heavy, flexible material.

One of the layers may comprise an air permeable membrane to provide a breathable garment and may also provide some protection from external moisture. In some embodiments the middle layer (190) or (200) that is not a fleece material may be an air permeable membrane. In some embodiments, layers (190) and (200) are bonded together. In some embodiments each layer is bonded to other adjacent layers. Bonded layers may be pre-bonded during manufacture of the fabric or bonded during construction of the heavyweight garment.

Figure 8:
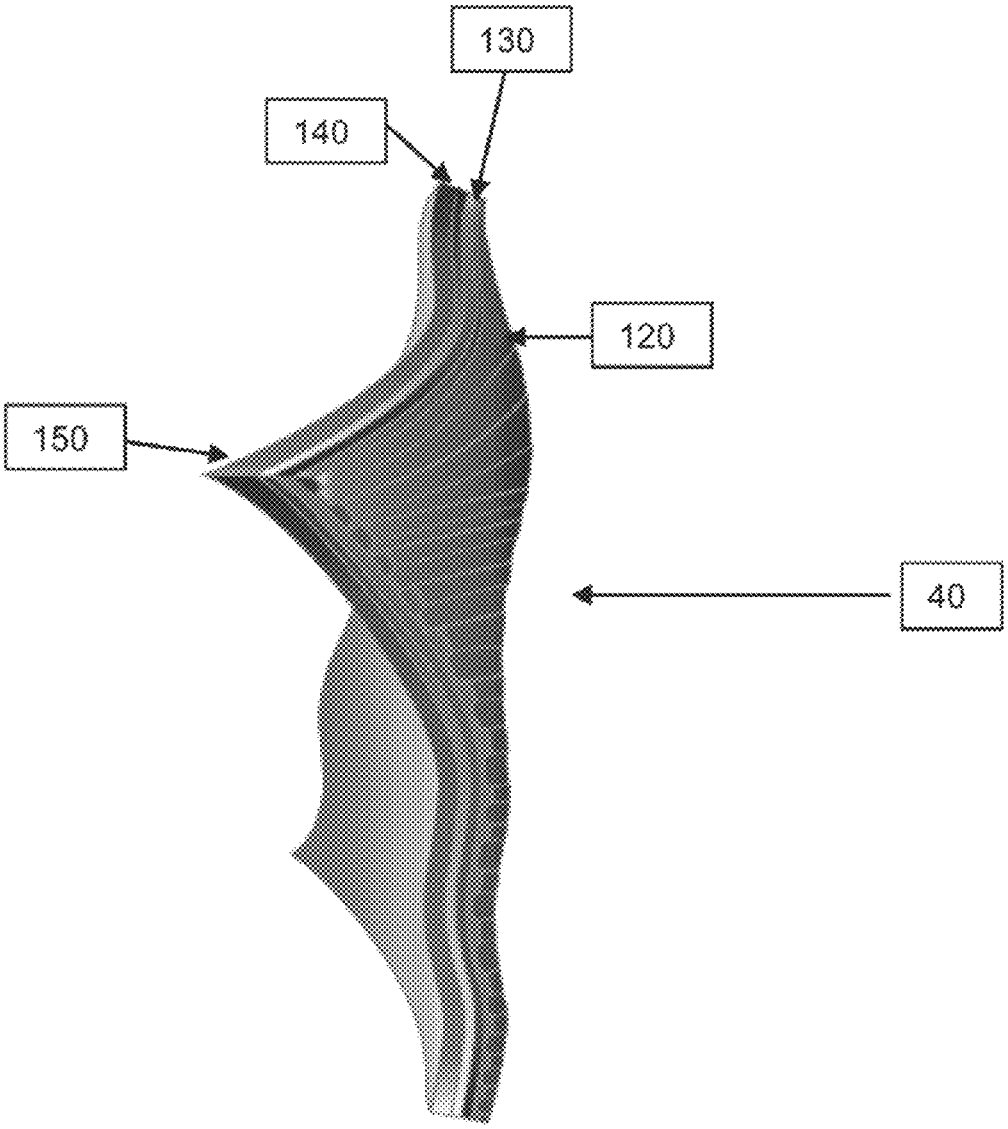
FIG. 8 depicts examples of cross-sectional views of a heavyweight fabric construction according to some other embodiments.

As examples, the outermost layer (210) and one of the middle layers (190) or (200) may be formed of TWEAVE® CORDURA® stretch woven material (e.g., 350 Grm material), POLARTEC® POWER STRETCH® fleece (e.g., 300 Grm fleece), or a combination thereof. In some embodiments the innermost layer (180) may be formed of a POLARTEC® POWER GRID™ fleece (e.g., 305 Grm fleece). An example of such configurations is shown in FIG. 8. However, other heavy, flexible materials (e.g., other heavy stretchable fleece materials) may also be suitable.

In some embodiments, the heavyweight fabric comprises 3 layers. Referring again to FIG. 6A, a garment comprising 3 layers may remove one of the inner layers (190). In some other embodiments, 2 layers (an outer layer and a lining) or even a single layer of heavyweight fabric may be used to form the heavyweight garment. Preferably, the heavyweight fabric is sufficiently heavy (having sufficient density) to form a garment having the total garment weight described above.

Figure 6B:
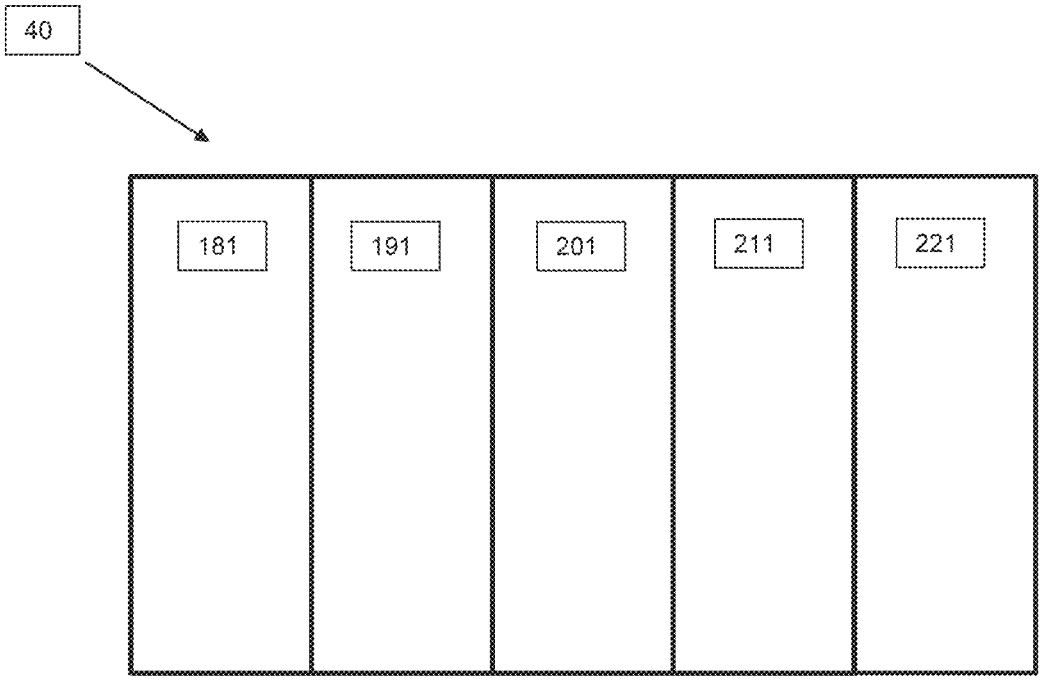
FIG. 6B depicts an example of a cross-sectional view of a heavyweight fabric construction according to some embodiments.

Referring now to FIG. 6B. In some embodiments, the heavyweight fabric may comprise five layers. There may be an inner layer of material (181). Between the inner layer of material and a middle layer of material (201) there may be a layer of adhesive (191). Between the middle layer of material (201) and the outer layer of material (221) there may be another layer of adhesive (211). The layers of material (181) (201) and (221) may be comprised of a fleece material or a different material. The layers of material (181) (201) and (221) may be comprised of the same material or of different materials. The adhesive layers (191) and (211) may be thick enough to add significant weight to the heavyweight fabric. For instance, the adhesive layers (191) and (211) may make up about 10% or more, about 15% or more, about 20% or more, about 25% or more, about 30% or more, or about 35% or more of the weight of the fabric per unit area (e.g., per square foot, or per square yard).

Referring again to FIG. 6A, in some embodiments, one or more of the layers of material forming heavyweight fabric may comprise a heavy polymer layer that is not breathable. For example, one or more of the innermost layer (180), outermost layer (210), or middle layers (190) (200) may comprise the heavyweight polymer layer.

Figure 7:
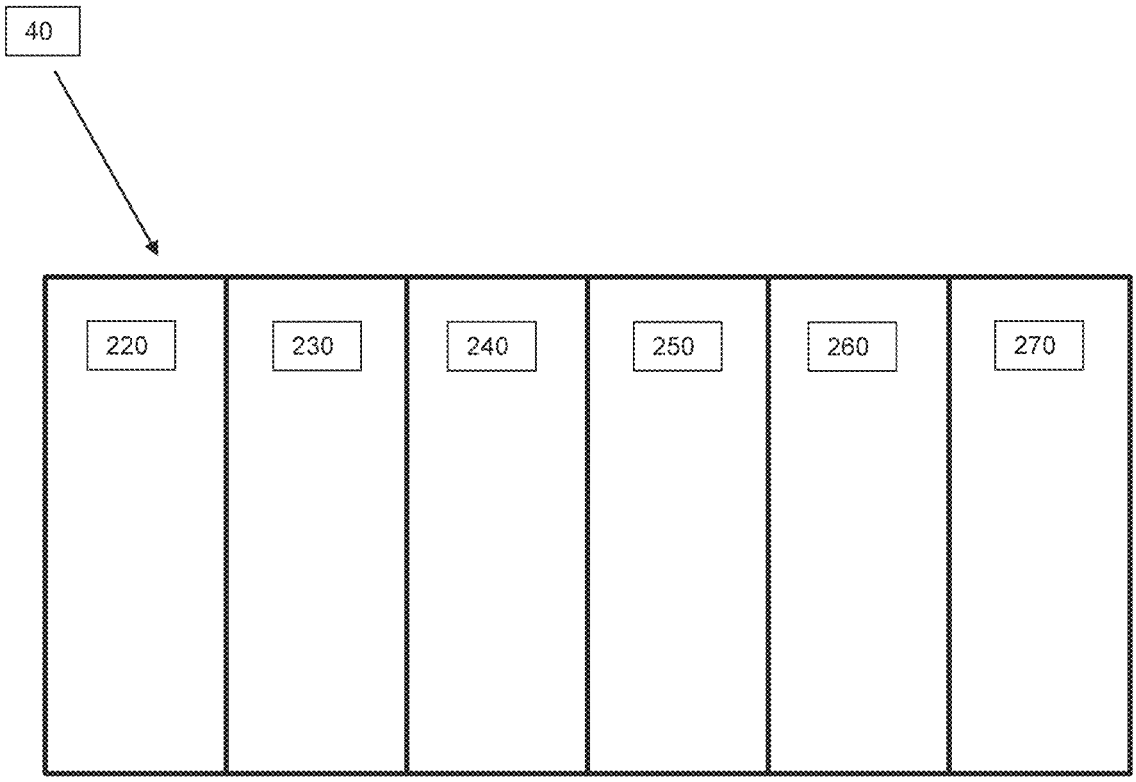
FIG. 7 depicts an example of a cross-sectional view of a heavyweight fabric construction according to some other embodiments.

In some embodiments, the heavyweight fabric may comprise more than 4 layers. Referring to FIG. 7, the heavyweight fabric may comprise 6 or more layers of material. The 6 layers may comprise a double trilayer in which inner trilayer is a liner that comprises the layers (220), (230), and (240) and the outer trilayer is a shell that comprises the layers (250), (260), and (270). In some embodiments, the inner liner trilayer may be detachable from the outer shell trilayer. In some embodiments, the (240) and (250) layers may be bonded or stitched together.

The shell trilayer may be comprised of a coating that provides a direct water repellent. In some embodiments, the direct water repellent material comprises fluorine or is fluoropolymer based. The inner layers of each trilayer (230) and (260) may comprise a heavyweight membrane. The heavyweight membrane may be comprised of a clear sheet material and/or may be comprised polyurethane film. In some embodiments, the heavyweight membrane has a thickness of 1 mm, 2 mm, 3 mm, or 4 mm. The outer layers of each trilayer (220), (240), (250), and (270) may comprise a fabric comprising textile fibers such as nylon, polyester, or spandex.

Various specific embodiments have been described. However, modifications and changes may be made without departing from the broader spirit and scope of the disclosures herein. The specification and drawings are, accordingly, to be regarded in an illustrative rather than restrictive sense.

The disclosed systems and methods each have several innovative aspects, no single one of which is solely responsible or required for their desirable attributes. The features and processes described above may be used independently of one another or in combination. All possible combinations and subcombinations fall within the scope of this disclosure. For example, the garment disclosed herein may include one or more, or all of the properties disclosed herein regarding: the total weight of the heavyweight garment, the weight per unit area of the fabric forming the garment, the construction of the fabric forming the garment, the MVTR or permeability rate of the garment fabric, etc.

Certain features that are described in this specification in the context of separate embodiments also may be implemented in combination in a single embodiment. Conversely, various features that are described in the context of a single embodiment also may be implemented in multiple embodiments separately or in any suitable subcombination. Moreover, although features may be described above as acting in certain combinations and even initially claimed as such, one or more features from a claimed combination may in some cases be excised from the combination, and the claimed combination may be directed to a subcombination or variation of a subcombination. No single feature or group of features is necessary or indispensable to each and every embodiment.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. The terms "comprising," "including," "having," and the like are synonymous and are used inclusively, in an open-ended fashion, and do not exclude additional elements, features, acts, operations, and so forth. The term "or" is used in its inclusive sense so that when used, for example, to connect a list of elements, the term "or" means one, some, or all of the elements in the list. In addition, the articles "a," "an," and "the" as used in this application and the appended claims are to be construed to mean "one or more" or "at least one" unless specified otherwise.

What is claimed is:

1. A heavyweight jacket comprising:

a main body configured to fit on a torso of a human wearer;

one or more sleeves configured to fit on an arm of the wearer, wherein the one or more sleeves are detached from the main body, wherein the main body and one or more sleeves are formed of fabric having a uniform density of 8 or more ounces per square yard wherein the fabric comprises a plurality of layers of material bonded together to form a pre-bonded fabric, wherein a first and a second of the plurality of layers of material making up the pre-bonded fabric are bonded together with an adhesive layer, wherein the adhesive layer provides at least 20% of a weight of the pre-bonded fabric per yard.

2. The heavyweight jacket of claim 1, wherein the fabric is a fleece fabric.

3. The heavyweight jacket of claim 1, wherein the one or more sleeves taper from one open end of the one or more sleeves to another open end of the one or more sleeves, the one or more sleeves comprising inside faces and outside faces, the inside faces of the one or more sleeves being proximate the torso of a wearer and the outside faces of the one or more sleeves being distal the torso of a wearer, when worn by the wearer, the inside faces being thinner than the outside faces of the one or more sleeves.

4. The heavyweight jacket of claim 1, wherein at least some of the heavyweight jacket is composed of pre-bonded fabric having three or more layers.

5. The heavyweight jacket of claim 1, wherein a total weight of the jacket is 6-10 pounds.

6. The heavyweight jacket of claim 1, wherein the fabric has a MVTR between about 100 $g/m^2$/day and about 1,500 $g/m^2$/day.

7. The heavyweight jacket of claim 1, wherein the fabric has a uniform density of 24 or more ounces per square yard.

8. A heavyweight garment comprising:

a fabric having a density greater than 8 ounces per square yard, the fabric comprising:

two or more pre-bonded layers of material with at least an innermost layer and an outermost layer, wherein the two or more pre-bonded layers of material are permeable to water vapor and together have a MVTR between about 100 $g/m^2$/day and about 1,500 $g/m^2$/day, wherein the two or more pre-bonded layers of material comprise a first and a second layer of fleece material bonded together to form a pre-bonded fabric, wherein the first and the second of the plurality of layers of fleece material are bonded together with an adhesive layer, wherein the adhesive layer provides at least 20% of the weight of the pre-bonded fabric per yard.

9. The heavyweight garment of claim 8, wherein the heavyweight garment is a pair of pants.

10. The heavyweight garment of claim 8, wherein the garment is a jacket comprising:

a main body configured to fit on a torso of a human wearer;

one or more sleeves configured to fit on an arm of the wearer, wherein the one or more sleeves are detached and discontinuous with the main body, the one or more sleeves tapering from one open end to an opposite open end of the one or more sleeves, the one or more sleeves having inner faces and outer faces, the inner faces of the one or more sleeves being proximate the torso of a wearer and the outer faces of the one or more sleeves being distal the torso of a wearer, when worn by the wearer, the inner faces being thinner than the outer faces.

11. The heavyweight garment of claim 8, further comprising one or more patches that occupy between about 40% and about 70% of the heavyweight garment's surface area.

12. The heavyweight garment of claim 8, further comprising a ventilation system, wherein the ventilation system comprises one or more of vents, gaps, or a fabric with an MVTR greater than or equal to two times the MVTR of other fabric making up the heavyweight garment.

* * * * *